US007007607B1

(12) United States Patent
Fong et al.

(10) Patent No.: US 7,007,607 B1
(45) Date of Patent: Mar. 7, 2006

(54) MISSILE SYSTEM FOR BREACHING REINFORCED CONCRETE BARRIERS UTILIZING HINGED EXPLOSIVELY FORMED PROJECTILE WARHEADS

(75) Inventors: Richard Fong, Rockaway, NJ (US); William Ng, Fort Lee, NJ (US); LaMar Thompson, Orange, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 140 days.

(21) Appl. No.: 10/709,120

(22) Filed: Apr. 14, 2004

(51) Int. Cl.
*F42B 12/06* (2006.01)

(52) U.S. Cl. ..... 102/489; 102/400; 102/476

(58) Field of Classification Search ..... 102/489, 102/475, 476, 510, 351, 394, 477, 478, 311, 102/316, 314, 400
See application file for complete search history.

(56) References Cited

U.S. PATENT DOCUMENTS 3,712,229 A * 1/1973 Schock ..... 102/489
6,021,716 A * 2/2000 Taylor ..... 102/517
6,186,070 B1 * 2/2001 Fong et al. ..... 102/476
6,510,797 B1 * 1/2003 Fong ..... 102/476
6,619,210 B1 * 9/2003 Spivak et al. ..... 102/476
6,868,791 B1 * 3/2005 Thompson et al. ..... 102/476

* cited by examiner

*Primary Examiner*—Michael J. Carone
*Assistant Examiner*—Stewart Knox
(74) *Attorney, Agent, or Firm*—Robert Charles Beam; John F. Moran

(57) ABSTRACT

A hinged explosively formed projectile warhead system eliminates exposure of soldiers to harm in wall breaching operations by providing a lethal mechanism that can be deployed at safe distances, simultaneously breaching a man-sized hole and removing one or more rows of rebar in reinforced concrete structures or barriers. The warhead system employs both a missile system and explosively formed projectile warhead technology delivered to the target from a tube launched platform. A set of warhead arms is attached to the aft end of a missile body by means of a set of hinges. The warhead arms are initially folded against the missile body. After launch of the warhead system, the warhead arms fold away from the missile body. The angle at which the warhead arms are folded from the missile body determines the area of a hole breached by the warhead system in a reinforced concrete target.

15 Claims, 4 Drawing Sheets

NOTE: PLEASE SHOW MISSILE SYSTEM WITH HINGE ANGLE AT 45°

MISSILE SYSTEM FOR BREACHING REINFORCED CONCRETE BARRIERS UTILIZING HINGED EXPLOSIVELY FORMED PROJECTILE WARHEADS

FEDERAL RESEARCH STATEMENT

The inventions described herein may be manufactured, used and licensed by or for the U.S. Government for U.S. Government purposes.

BACKGROUND OF INVENTION

1. Field of the Invention

The present invention generally relates to the field of ballistics and in particular to explosively formed projectiles. More specifically, the present invention pertains to a projectile utilizing explosively formed projectile warheads on hinged arms to breach a reinforced concrete barrier.

2. Background of the Invention

A continuing need in the Army is the ability to effectively breach man-sized holes in reinforced concrete barriers or walls. A conventional approach to breaching man-sized holes utilizes demolition or bulk explosive charges that are hand emplaced and detonated on the target. Another conventional approach to breaching man-sized holes utilizes explosively formed projectiles. The explosively formed projectile is created by using an explosive energy to deform a metal plate into a coherent penetrator while simultaneously accelerating the coherent penetrator to high velocities. Although these breaching technologies have proven to be useful, it would be desirable to present additional improvements.

After forming the initial breach, a second manual operation is typically required to remove reinforcing rebar in the reinforced concrete barrier. This manual removal of rebar is a lengthy process during which the soldier is exposed to harm. What is therefore needed is a system that has the capability of effectively removing rebar while simultaneously breaching the reinforced concrete barrier that can be deployed some distance from a target, reducing exposure of the soldier to harm. The need for such a system has heretofore remained unsatisfied.

SUMMARY OF INVENTION

A hinged explosively formed projectile warhead system (referred to herein as "the system" or "the present system") eliminates exposure of soldiers to harm in wall breaching operations by providing a breaching mechanism that can be deployed at safe distances. Such requirements typically exist in Military Operations in Urban Terrain (MOUT) environments where the infantry soldier plays a key role. The present system simultaneously breaches a man-sized hole and removes one or more rows of rebar in reinforced concrete structures or barriers. The present system employs both a missile system and an explosively formed projectile warhead technology delivered to the target from a tube launched platform.

The present system comprises a set of warhead arms attached to the aft end of a missile body by means of a set of hinges. The warhead arms are initially folded against the missile body. After launch of the present system, the warhead arms fold away from the missile body. The angle at which the warhead arms are folded from the missile body determines the area of the hole breached by the present system in a reinforced concrete target.

The warheads are made of a high density liner material, such as tantalum, for increased penetration into hardened concrete targets.

In an embodiment, the warhead arms are released from the missile body prior to impact at a reinforced concrete target. In a further embodiment, release of the warhead arms initiates a time delay fuzing mechanism for the explosives in the warhead arms. One advantage of this embodiment entails the capability of the warhead to form a long non-bifurcating wedge shaped penetrator that covers a wide area of the target. By utilizing multiple warheads, large holes are able to be breached that allows access for infantrymen to pass through.

BRIEF DESCRIPTION OF DRAWINGS

The various features of the present invention and the manner of attaining them will be described in greater detail with reference to the following description, claims, and drawings, wherein reference numerals are reused, where appropriate, to indicate a correspondence between the referenced items, and wherein:

DETAILED DESCRIPTION

Figure 1:
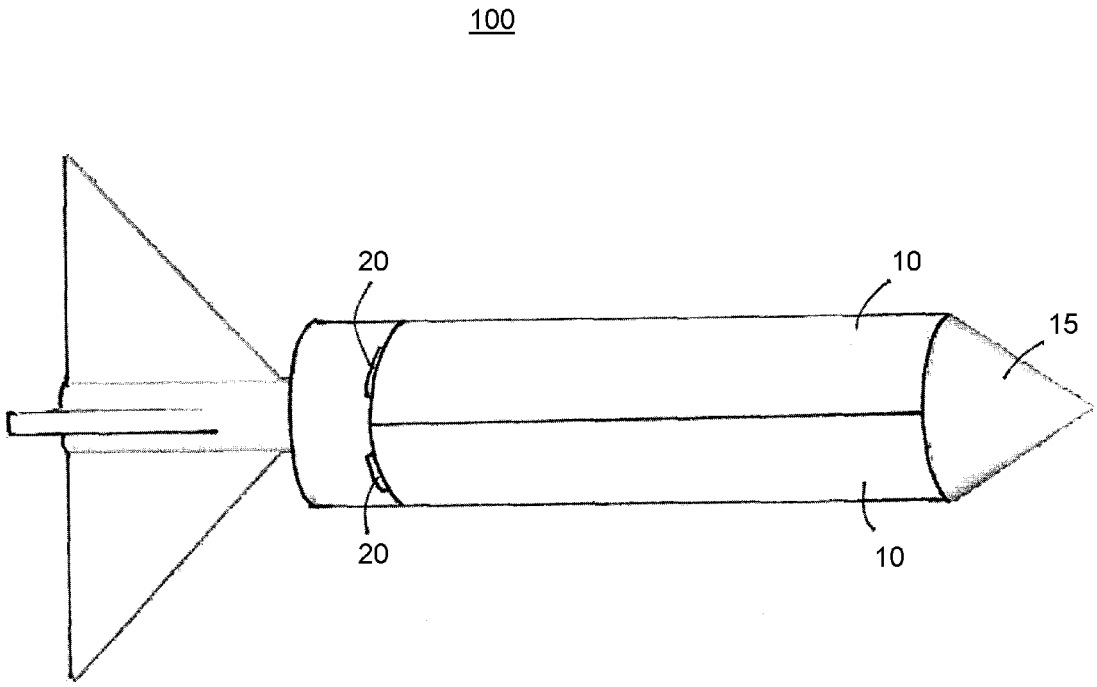
FIG. 1 is a diagram of a hinged explosively formed projectile warhead missile system of the present invention in launch configuration.

FIG. 1 (FIGS. 1A, 1B) illustrates an exemplary hinged explosively formed projectile warhead missile system 100 (referenced herein as missile system 100) comprising a set of hinged explosively formed warheads 10 (referenced herein as warheads 10), a missile body 15, and hinges 20. The warheads 10 are attached to the aft end of the missile body 15 by means of hinges 20. When detonated, warheads 10 form explosively formed projectiles. Known or available explosively formed projectile techniques can be used to practice the invention. For further details about explosively formed projectile warheads, reference is made, for example, to the U.S. Pat. No. 6,619,210.

Figure 2:
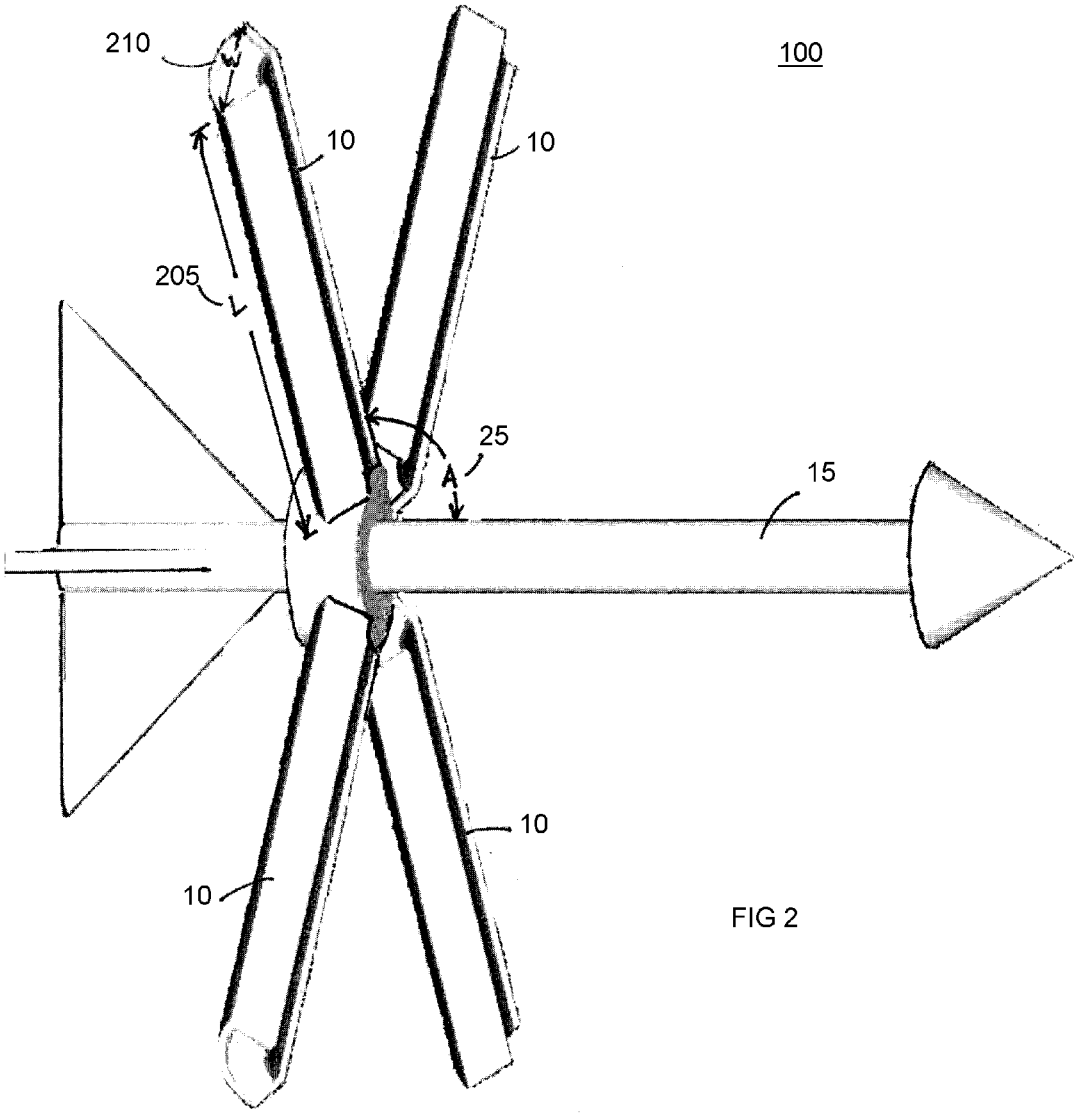
FIG. 2 is a diagram of the hinged explosively formed projectile warhead missile system of FIG. 1 in deployed configuration during flight.

The warheads 10 are initially folded up against the missile body 15 as illustrated in FIG. 1. Missile system 100 is launched from a tube platform at a very low spin rate to induce stabilization during flight. After launch, the warheads 10 fold out at a hinge angle A, 25, from the forward section of the missile body 15, as illustrated by the drawing of FIG. 2. In an embodiment, the hinge angle A, 25, is 90 degrees, as illustrated in FIG. 2.

In the embodiment illustrated by FIG. 2, the missile system 100 comprises four warheads 10. In another embodiment, the missile system 100 comprises, for illustration purpose only, eight warheads 10. It being understood that the number of warheads 10 can vary, such as for example, between 2 to 8 warheads.

The length L, 205, and the width, W, 210, of each of the warheads 10, preferably, but not necessarily, range between approximately 150 mm and 450 mm and 105 mm to 120 mm, respectively. These dimensions are used as examples to accommodate current shoulder and gun launched missile systems. The missile body can but does not necessarily have to compose of composite materials for weight reduction and strength. The missile body also composes the housing body of the EFP warhead which confines the explosive charge, therefore prior to detonation there is no discarding of sabots or outer missile skin sleeves.

Figure 3:
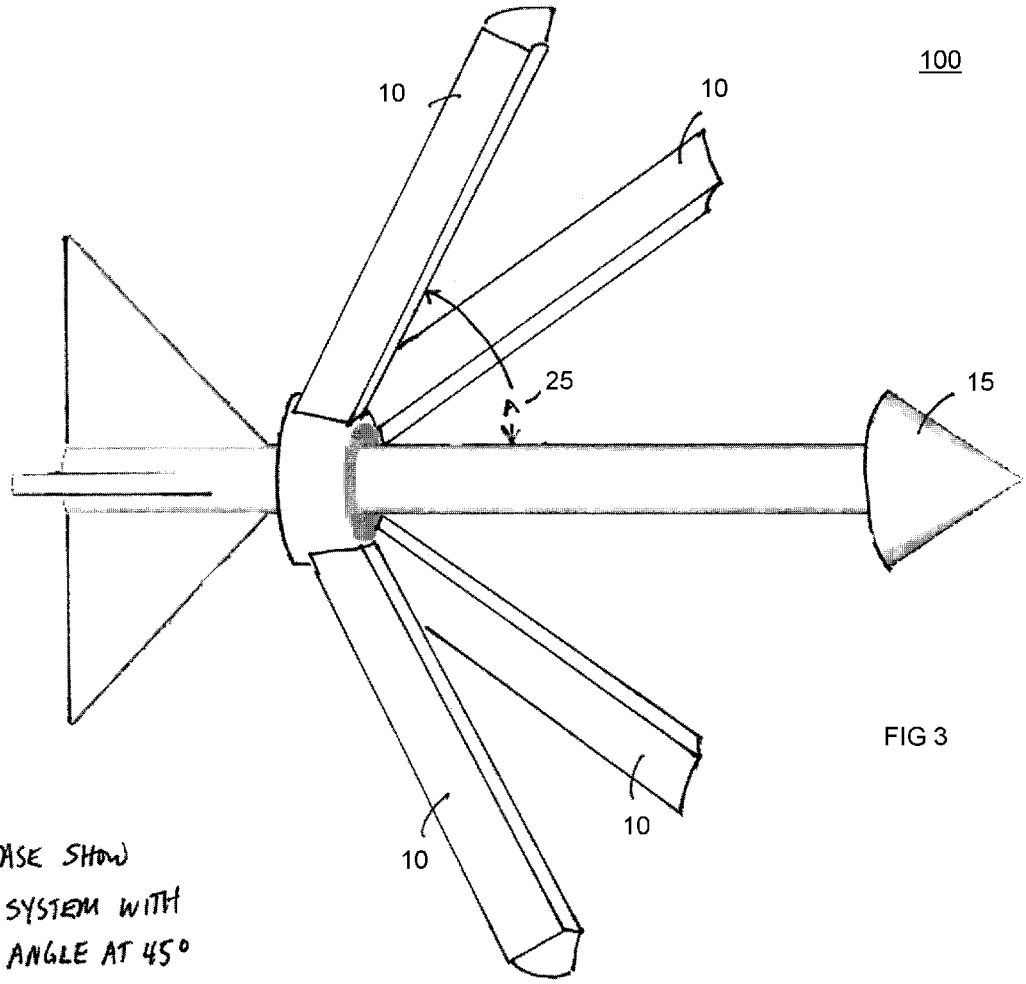
FIG. 3 is a diagram of the hinged explosively formed projectile warhead missile system of FIG. 1 deployed at an exemplary hinge angle of 45 degrees.

In a further embodiment, hinges 20 comprise additional hinge points by which the hinge angle A, 25, may be varied. FIG. 3 illustrates the hinge angle A, 25, at, for example, 45 degrees. The hinge angle A, 25, determines the area of reinforced concrete that is removed by missile system 100. At a small value for hinge angle A, 25, the warheads 10 are focused in a convergent pattern that produces a small hole in a reinforced concrete target. At a larger value for hinge angle A, 25, the warheads 10 are in a divergent pattern that produces a much larger hole in the reinforced concrete target.

Figure 4:
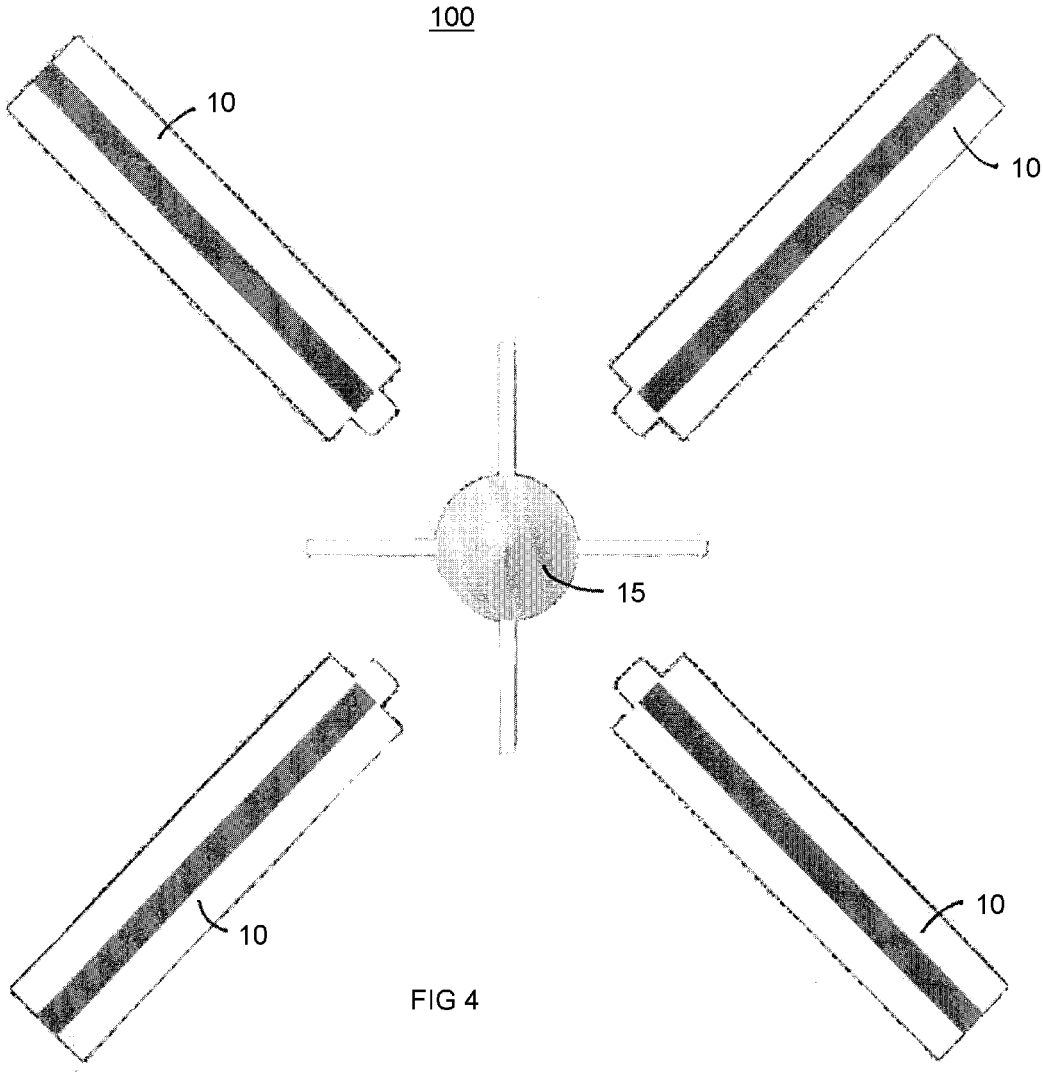
FIG. 4 illustrates a diagram of an end view of an embodiment in which the warhead arms are released from a missile body of the hinged explosively formed projectile warhead missile system of FIG. 1 prior to target impact, it being understood that the arms are not required to be released prior to impact, which allows for the selection of the direction of the blast for specific targets and which minimizes collateral damage.

In an embodiment, a release mechanism releases the warheads 10 before the missile system 100 impacts the reinforced concrete target, allowing each of the warheads 10 to detach from the missile body 15 as illustrated by the end view of the diagram of FIG. 4.

In a further embodiment, detachment of the warheads 10 from the missile system 10 functions as a time delay fuzing mechanism for the explosives in the warheads 10.

Upon detonation of the warheads 10, the chemical energy of the high explosive in the warheads 10 is converted into many kinetic energy explosively-formed rebar-piercing projectiles. The kinetic energy explosively-formed rebar-piercing projectiles penetrate the reinforced concrete wall or barrier, producing a hole in the target that is man-sized or larger. Additionally, the blast of the HE removes a large portion of the concrete.

It is to be understood that the specific embodiments of the invention that have been described are merely illustrative of certain applications of the principle of the present invention. Numerous modifications may be made to a missile system for breaching reinforced concrete barriers utilizing hinged explosively formed projectile warheads described herein without departing from the spirit and scope of the present invention.

What is claimed is:

1. A missile system for breaching reinforced concrete barriers utilizing a plurality of hinged explosively formed projectile warheads, the missile system comprising:

a missile body for transporting the hinged explosively formed projectile warheads to a target;

a plurality of hinges for attaching the hinged explosively formed projectile warheads to the missile body;

wherein the hinged explosively formed projectile warheads are initially folded against the missile body prior to a launch of the missile system; and wherein the hinged explosively formed projectile warheads unfold away from the missile body to a deployed position after the launch of the missile system.

2. The missile system of claim 1, wherein the hinged explosively formed projectile warheads comprises a high density liner material.

3. The missile system of claim 1, wherein the deployed position comprises a hinge angle formed by each of the hinged explosively formed projectile warheads with respect to the missile body.

4. The missile system of claim 2, wherein the hinges comprise a plurality of hinge points at which the hinge angle is set.

5. The missile system of claim 3, wherein the hinge angle is 90 degrees.

6. The missile system of claim 3, wherein the hinge angle ranges between approximately zero degree and 90 degrees.

7. The missile system of claim 3, wherein the missile system operating with a small value for the hinge angle produces a small hole in a reinforced concrete target.

8. The missile system of claim 3, wherein the missile system operating with a large value for the hinge angle produces a large hole in the reinforced concrete target.

9. The missile system of claim 1, wherein a release of the hinged explosively formed projectile warheads from the missile body is initiated prior to an impact at the reinforced concrete target.

10. The missile system of claim 9, wherein the release initiates a time delay fuzing mechanism for a plurality of explosives in the hinged explosively formed projectile warheads.

11. The missile system of claim 1, wherein the plurality of hinged explosively formed projectile warheads comprise four hinged explosively formed projectile warheads.

12. The missile system of claim 1, wherein the number of the plurality of hinged explosively formed projectile warheads ranges between 2 and 8 warheads.

13. The missile system of claim 1, wherein a length of each hinged explosively formed projectile warhead ranges between approximately 150 mm and 450 mm.

14. The missile system of claim 1, wherein a diameter of each hinged explosively formed projectile warhead ranges between approximately 105 mm and 120 mm.

15. The missile system of claim 2, wherein the high density liner material is tantalum.

* * * * *